US008754813B2

(12) United States Patent
Kwak

(10) Patent No.: US 8,754,813 B2
(45) Date of Patent: Jun. 17, 2014

(54) APPARATUS FOR PROTECTING HUMAN BODY FROM ELECTROMAGNETIC WAVES

(75) Inventor: Sang il Kwak, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 122 days.

(21) Appl. No.: 13/242,603

(22) Filed: Sep. 23, 2011

(65) Prior Publication Data

US 2012/0075157 A1 Mar. 29, 2012

(30) Foreign Application Priority Data

Sep. 27, 2010 (KR) ..... 10-2010-0093197
Dec. 23, 2010 (KR) ..... 10-2010-0133403

(51) Int. Cl.
*H01Q 1/38* (2006.01)

(52) U.S. Cl.
USPC ..... 343/700 MS; 343/909; 343/841

(58) Field of Classification Search
USPC ..... 343/700 MS, 909, 841
See application file for complete search history.

(56) References Cited

U.S. PATENT DOCUMENTS

2007/0182636 A1* 8/2007 Carlson ..... 343/700 MS
2009/0237323 A1 9/2009 Kwak et al.
2010/0127943 A1* 5/2010 Inoue et al. ..... 343/702

FOREIGN PATENT DOCUMENTS

JP 2010-028182 A 2/2010
KR 2008-0080828 A 9/2008
KR 2009-0100031 A 9/2009

OTHER PUBLICATIONS

Zhu et al., Dual-Band Wearable Textile Antenna on an EBG Substrate, IEEE transactions on antennas and propagation, vol. 57, No. 4, Apr. 2009.
Kwak et al., Design of Wearable Communication Device for Body Protection from EM wave using the EBG structure, Proceedings of the 40th European Microwave Conference, Sep. 28-30, 2010, pp. 1433-1436.

* cited by examiner

*Primary Examiner* — Dieu H Duong
(74) *Attorney, Agent, or Firm* — Rabin & Berdo, P.C.

(57) ABSTRACT

An apparatus for protecting a human body from electromagnetic waves includes: a radiator including an antenna; and a periodic structure that is combined with the radiator to form a radiation unit and has a plurality of unit cells periodically arranged, wherein each of the unit cells of the periodic structure contains a ground layer; an electromagnetic bandgap (EBG) board formed on the ground layer and serving as a dielectric spacer; and an EBG pattern made of metal and formed on the EBG board.

8 Claims, 3 Drawing Sheets

APPARATUS FOR PROTECTING HUMAN BODY FROM ELECTROMAGNETIC WAVES

CROSS-REFERENCE(S) TO RELATED APPLICATION(S)

The present invention claims priority of Korean Patent Applications No. 10-2010-0093197, filed on Sep. 27, 2010 and No. 10-2010-0133403, filed on Dec. 23, 2010, which are incorporated herein by reference.

FIELD OF THE INVENTION

The present invention relates to an apparatus for protecting a human body from electromagnetic waves; and, more particularly, to an apparatus for protecting a human body from electromagnetic waves which are generated from wearable communication devices.

BACKGROUND OF THE INVENTION

Recently, communication devices such as health monitoring devices employing an RFID (Radio Frequency Identification) and a wearable computer are being used. Such devices are used in contact with the human body over a long period of time, unlike a mobile phone used in a close distance for a short period of time. Therefore, electromagnetic waves generated at frequency bands used in such communication devices may more affect the human body, so that the effect of electromagnetic waves on the human body has significantly become important.

For the present, the effect of electromagnetic waves on the human body has not been clearly revealed, but, it has been reported that there is a possibility of the electromagnetic waves influencing various diseases such as leukemia, a brain tumor and a headache. Moreover, when the body is exposed to the electromagnetic waves for a long period of time and/or in a very close distance, the effect may be considerably increased.

Technologies in regard to the effect of electromagnetic waves on the human body have been mainly about a mobile phone used close to the head part.

As conventional technologies for reducing electromagnetic waves regarding the mobile phone, there have been introduced an electromagnetic absorber, a technique of using an electromagnetic interference (EMI) paint, and a technique of changing the structure of a radiator such as antenna. Further, there is a technique of using electromagnetic bandgap (EBG), which engraves a periodic metal pattern on a substrate made of a dielectric and the like to thereby change electromagnetic characteristics of a radiator.

However, communication devices used in contact with the human body such as a wearable device are gradually increasing, and thus in order to prevent a bad influence of such devices on the body, more studies for blocking or reducing the electromagnetic waves are required.

SUMMARY OF THE INVENTION

In view of the above, the present invention provides an apparatus for protecting a human body from electromagnetic waves, which is applicable to various wearable communication devices and minimizes the amount of electromagnetic waves being absorbed into the human body by designing a radiation unit including a periodic structure and an antenna.

In accordance with an aspect of the present invention, there is provided an apparatus for protecting a human body from electromagnetic waves, including: a radiator including an antenna; and a periodic structure that is combined with the radiator to form a radiation unit and has a plurality of unit cells periodically arranged.

Further, the radiator of the apparatus may include: an antenna board disposed in upper center of the periodic structure; an antenna formed on the antenna board; a via for connecting the antenna board and the antenna to the ground; and a feeding terminal for feeding a signal by electrically connecting the antenna board to the antenna.

Further, each of the unit cells of the periodic structure may include: a ground layer; an electromagnetic bandgap (EBG) board formed on the ground layer and serving as a dielectric spacer; and an EBG pattern made of metal and formed on the EBG board.

BRIEF DESCRIPTION OF THE DRAWINGS

The objects and features of the present invention will become apparent from the following description of embodiments, given in conjunction with the accompanying drawings, in which.

DETAILED DESCRIPTION OF THE EMBODIMENTS

Hereinafter, embodiments of the present invention will be described with reference to the accompanying drawings which form a part hereof.

In the following description of the present invention, if the detailed description of the already known structure and operation may confuse the subject matter of the present invention, the detailed description thereof will be omitted. The following terms are terminologies defined by considering functions in the embodiments of the present invention and may be changed operators intend for the invention and practice. Hence, the terms should be defined throughout the description of the present invention.

In the embodiment of the present invention, an apparatus for protecting a human body from electromagnetic waves is implemented by employing a radiation unit comprising a periodic structure such as an electromagnetic bandgap (EBG) and an antenna. When the electromagnetic bandgap, which is usable to reduce electromagnetic waves, is combined with a radiator such as an antenna to form the radiation unit, artificial magnetic conductor characteristics are implemented and a surface of the periodic structure become to have high impedance. Such high impedance reduces a surface current and suppresses creation of surface waves, thereby reducing unnecessary electromagnetic waves.

Further, the electromagnetic waves can be reduced without degradation of a performance of the radiator by changing radiation characteristics of the radiator as desired by using the characteristics of the artificial magnetic conductor. If this technology is applied to a wearable communication device, the wearable communication device can protect the human body from the electromagnetic waves although the device is in contact with the body by changing a radiation pattern of the radiation unit to be harmless to the body.

Figure 1:
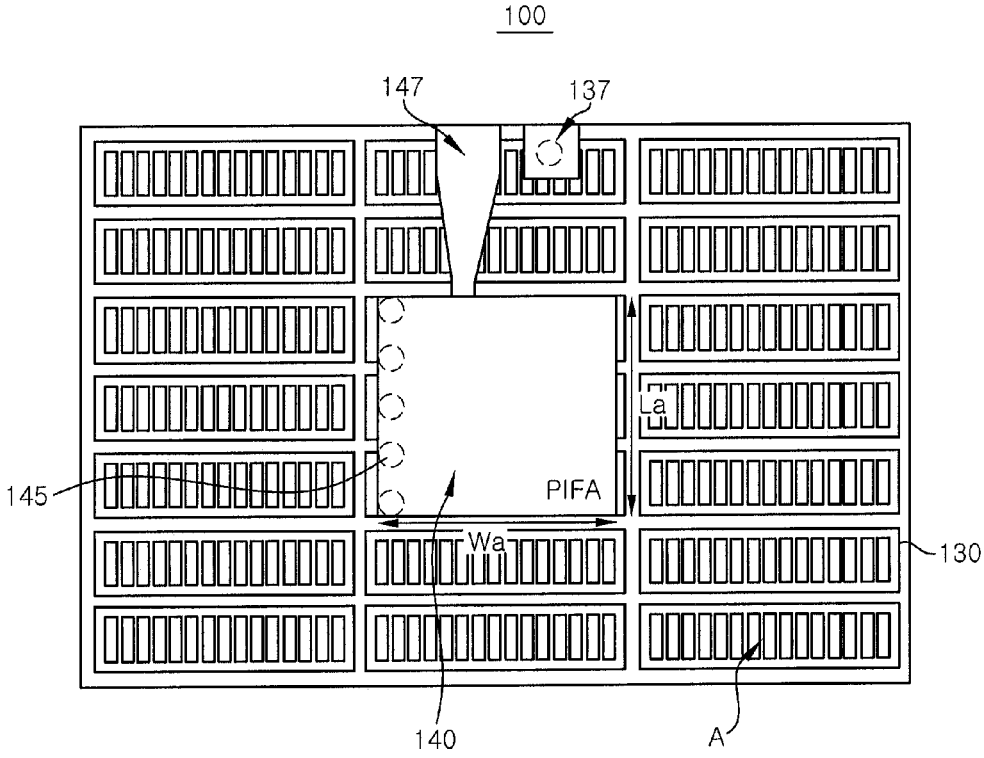
FIG. 1 is a top view of an apparatus for protecting a human body from electromagnetic waves in accordance with an embodiment of the present invention.
Figure 2:
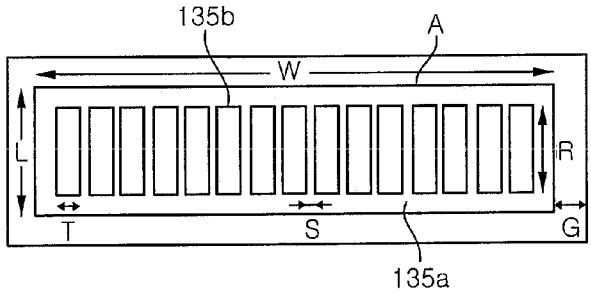
FIG. 2 is a top view of a unit cell composing a periodic structure of the apparatus for protecting the human body from electromagnetic waves in accordance with the embodiment of the present invention.

FIG. 1 is a top view of an apparatus for protecting a human body from electromagnetic waves in accordance with an embodiment of the present invention; FIG. 2 is a top view of a unit cell composing a periodic structure of the apparatus for protecting the human body from electromagnetic waves in accordance with the embodiment of the present invention; and FIG. 3 is a block diagram, viewed from the side, of the apparatus for protecting the human body from electromagnetic waves.

Figure 3:
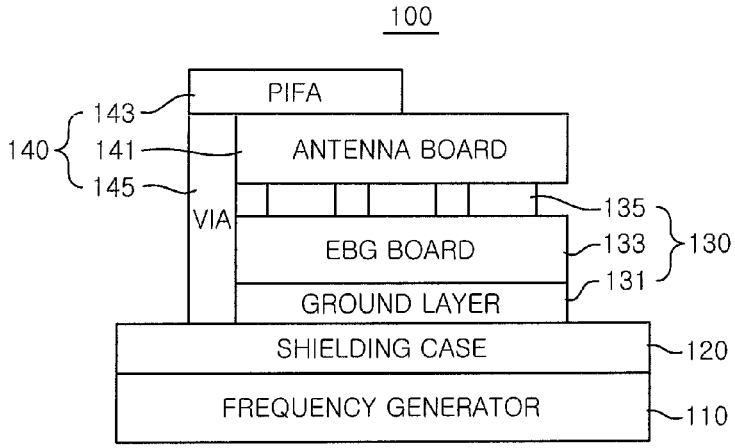
FIG. 3 is a block diagram, viewed from the side, of the apparatus for protecting the human body from electromagnetic waves.

Referring to FIGS. 1 to 3, an apparatus 100 for protecting a human body from electromagnetic waves includes a radiator 140 and a periodic structure 130 that is combined with the radiator 140 to form a radiation unit. The periodic structure 130 has a plurality of unit cells 'A' periodically arranged.

In FIG. 3, a reference numeral 110 indicates an electronic circuit being able to generate electromagnetic waves, and a reference numeral 120 indicates a shielding case for shielding electromagnetic waves generated in the electronic circuit 110. As the electronic circuit 110, for example, a frequency generator may be used.

The radiator 140 includes an antenna board 141 disposed in upper center of the periodic structure 130, an antenna 143 formed on the antenna board 141, a via 145 for connecting the antenna board 141 and the antenna 143 to the ground, and a feeding terminal 147 for feeding a signal by electrically connecting the antenna board 141 to the antenna 143. As the antenna 143, for example, a planar inverted-F antenna (PIFA) may be used. A resonance length La and/or width Wa of the antenna 143 can be adjusted to thereby set an operation frequency of the radiator 140.

Each of the unit cells 'A' of the periodic structure 130 includes a ground layer 131, an electromagnetic bandgap (EBG) board 133 formed on the ground layer 131 and serving as a dielectric spacer, and an EBG pattern 135 made of metal and formed on the EBG board 133.

The EBG pattern 135, as shown in FIG. 2, is comprised of a patch 135*a* made of metal and a plurality of slots 135*b* formed within the patch 135*a*. The patch 135*a* and the slots 135*b* may be, e.g., in a shape of rectangle, or may be in a variety of shapes such as a polygonal structure, a structure using genetic algorithm and the like.

The EBG pattern 135 may include a ground pad 137, shown in FIG. 1, for connecting the patch 135*a* to the ground layer 131.

The apparatus 100 having the above configuration can determine an operation frequency band of the electromagnetic waves by modifying a structure of the periodic structure 130. Specifically, the operation frequency band of the electromagnetic waves to be protected can be set by adjusting at least one of a gap 'G' between the unit cells 'A' adjacent to each other, a size (W and L) of the unit cell 'A' and a size (T, R and S) of the slot 135*b* in the patch 135*a*.

Here, the slot 135*b* can lower the frequency by lengthening a current flow. Therefore, the size of the unit cell 'A' can be reduced, compared to a unit cell not having the slots 135*b*, thereby contributing to a miniaturization of the unit cell 'A'.

Further, the operation frequency band of the electromagnetic waves can be set by modifying structures and/or shapes of the slots 135*b*.

The gap 'G' between the unit cells 'A' is a variable related to a capacitance affecting the EBG characteristics and the patch 135*a* of the unit cell 'A' is a variable related to an inductance. The insertion of slots 135*b* increases effect of the inductance to thereby help to miniaturize the unit cell 'A'.

The apparatus 100 for protecting the human body from electromagnetic waves decreases a surface current induced by the electromagnetic waves generated from a mobile communication terminal or a wearable communication device by using the periodic structure 130 in which a plurality unit cells 'A' are periodically arranged and protects the body from the electromagnetic waves by changing radiation pattern of the radiator 140.

Meanwhile, it has been presented in FIG. 3 that the shielding case 120 and the electronic circuit 110 are disposed under the radiation unit formed by combination of the periodic structure 130 and the radiator 140. This configuration of the apparatus 100 is to make the apparatus 100 be in a suitable size to wear. Even if the electronic circuit 110 is positioned around the radiation unit, electromagnetic reduction effect can be acquired.

Figure 4:
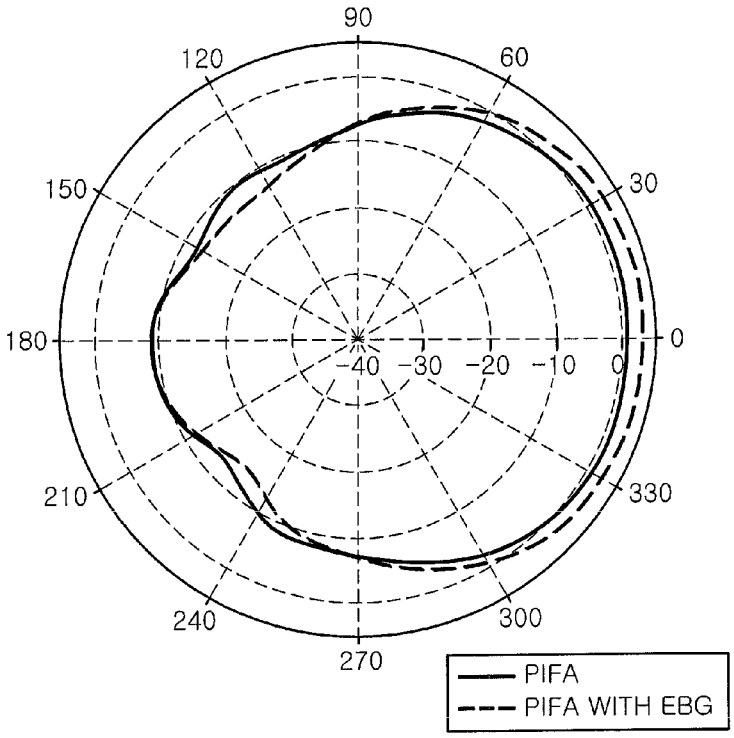
FIG. 4 is a view illustrating radiation patterns of electromagnetic waves generated from an antenna of a communication device.

FIG. 4 is a view illustrating radiation patterns of electromagnetic waves generated from an antenna of a communication device, in which a continuous line (PIFA) indicates a pattern when the apparatus 100 has been used, and a dashed line (PIFA with EBG) indicates a pattern when the apparatus 100 has not been used.

As shown in FIG. 4, when compared two radiation patterns, i.e., the dashed line with the continuous line, it is clearly seen that the use of the apparatus 100 for protecting the human body form electromagnetic waves reduces the radiation pattern toward the body.

The following Table 1 shows a specific absorption rate (SAR) of electromagnetic waves by the human body when the apparatus 100 has been used. The SAR has been measured at a wideband code division multiple access (WCDMA) frequency (1.98 GHz) band, and has been reduced by a maximum of 38% per 10 g.

TABLE 1

| Type | | SAR (10 g. Avg.) [W/kg] Value | Rate [%] |
|---|---|---|---|
| PIFA | 1.96 GHz | 1.04 | 100 |
| | 1.97 GHz | 1.15 | 100 |
| | 1.98 GHz | 0.959 | 100 |
| PIFA with EBG | 1.96 GHz | 0.699 | 67.2 |
| | 1.97 GHz | 0.714 | 62 |
| | 1.98 GHz | 0.73 | 76 |

Accordingly, it is confirmed that the apparatus for protecting the human body from electromagnetic waves in accordance with the present invention can actually protect the human body from the electromagnetic waves.

Figure 5:
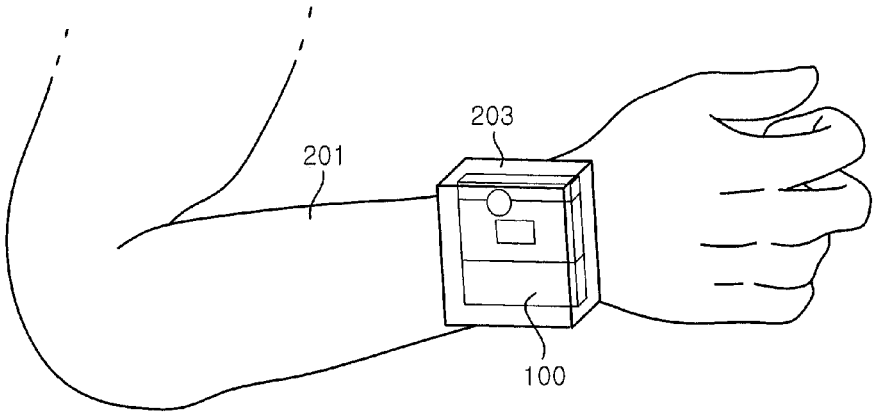
FIG. 5 shows an example of application of the apparatus for protecting the human body from electromagnetic waves in accordance with the embodiment of the present invention.

FIG. 5 shows an example of application of the apparatus for protecting the human body from electromagnetic waves in accordance with the embodiment of the present invention. As shown in FIG. 5, the apparatus 100 is positioned between a human body 201 and a wearable communication device 203 to protect the body 201 from the electromagnetic waves generated from the wearable communication device 203.

According to the embodiment of the present invention, an absorption rate of the electromagnetic waves by the human body can be reduced by adjusting a radiation pattern radiated from a wearable communication device by using the radiation unit including the periodic structure and the antenna.

While the invention has been shown and described with respect to the embodiments, it will be understood by those skilled in the art that various changes and modification may be made without departing from the scope of the invention as defined in the following claims.

What is claimed is:

1. An apparatus for protecting a human body from electromagnetic waves, comprising:

a radiator including an antenna; and a periodic structure that is combined with the radiator to form a radiation unit and has a plurality of unit cells periodically arranged, wherein each of the unit cells of the periodic structure includes:

a ground layer;

an electromagnetic bandgap (EBG) board formed on the ground layer and serving as a dielectric spacer; and an EBG pattern made of metal and formed on the EBG board, wherein:

the EBG pattern is comprised of a patch made of metal and a plurality of slots formed within the patch; and the radiator further includes an antenna board disposed in upper center of the periodic structure, such that a lower surface of the antenna board covers an entire upper opening of at least one of the plurality of slots.

2. The apparatus of claim 1, wherein the antenna is formed on the antenna board, and the radiator further includes:

a via for connecting the antenna board and the antenna to the ground; and a feeding terminal for feeding a signal by electrically connecting the antenna board to the antenna.

3. The apparatus of claim 1, wherein an operation frequency of the radiator is determined by adjusting a resonance length and/or width of the antenna.

4. The apparatus of claim 1, wherein the patch or each of the slots has a rectangular shape.

5. The apparatus of claim 1, wherein an operation frequency band of the electromagnetic waves is determined by modifying a structure of the periodic structure.

6. The apparatus of claim 1, wherein an operation frequency band of the electromagnetic waves is determined by modifying a structure and/or a shape of the slots.

7. The apparatus of claim 1, wherein an operation frequency band of the electromagnetic waves is determined by adjusting at least one of a gap between the unit cells adjacent to each other, a size of the unit cells and a size of the slots in the patch.

8. The apparatus of claim 1, wherein each of the plurality of slots, taken from a side view, includes an upper opening facing in an upward direction, a lower opening covered by an upper surface of the EBG board, and a sidewall extending between the upper and lower openings.

* * * * *